US005828042A

United States Patent [19]

Choi et al.

[11] Patent Number: 5,828,042

[45] Date of Patent: Oct. 27, 1998

[54] UNIFORM HEATING APPARATUS FOR MICROWAVE OVEN AND METHOD THEREOF

[75] Inventors: Joon Sik Choi, Seoul; Yang Kyeong Kim, Inchon, both of Rep. of Korea

[73] Assignee: LG Electronics Inc., Rep. of Korea

[21] Appl. No.: 890,706

[22] Filed: Jul. 11, 1997

[30] Foreign Application Priority Data

Jul. 11, 1996 [KR] Rep. of Korea ..... 1996 27905

[51] Int. Cl.[6] ..... H05B 6/68; H05B 6/74

[52] U.S. Cl. ..... 219/705; 219/708; 219/709; 219/746; 219/751

[58] Field of Search ..... 219/745, 746, 219/748, 751, 705, 708, 709

[56] References Cited

U.S. PATENT DOCUMENTS

| | | | |
|---|---|---|---|
| 4,121,078 | 10/1978 | Takano et al. | 219/746 |
| 4,185,182 | 1/1980 | Rueggeberg | 219/751 |
| 4,453,064 | 6/1984 | Toyoda et al. | 219/754 |
| 4,476,362 | 10/1984 | Kusunoki et al. | 219/748 |
| 5,347,108 | 9/1994 | Minakawa et al. | 219/708 |
| 5,512,736 | 4/1996 | Kang et al. | 219/704 |

*Primary Examiner*—Philip H. Leung
*Attorney, Agent, or Firm*—Ostrolenk, Faber, Gerb & Soffen LLP

[57] ABSTRACT

A uniform heating apparatus for a microwave oven and a method thereof which are capable of more uniformly heating food by generating various resonant modes based on the kind of food. The apparatus includes an oscillator unit having a wave guide tube for guiding microwaves generated by a magnetron to a lower portion of a heating chamber formed in a microwave oven main body, a resonant mode conversion unit for converting the microwaves guided to the lower portion of the heating chamber to have various resonant modes, a plurality of sensors for detecting the characteristics of food when the microwaves, the resonant mode of which is converted by the resonant mode conversion unit, are supplied to the food in the heating chamber, and a controller for controlling the oscillator unit and the resonant mode conversion unit in accordance with the characteristics of the food detected by the sensors.

1 Claim, 4 Drawing Sheets

UNIFORM HEATING APPARATUS FOR MICROWAVE OVEN AND METHOD THEREOF

BACKGROUND OF THE INVENTION

1. Field of the Invention

The present invention relates to a uniform heating apparatus for a microwave oven and a method thereof, and in particular to an improved uniform heating apparatus for a microwave oven and a method thereof which are capable of more uniformly heating food by generating microwaves in various resonant modes based on the kind of a food to be cooked.

2. Description of the Conventional Art

FIG. 1 illustrates a conventional microwave oven. As shown therein, the conventional microwave oven includes a heating chamber 1 formed therewithin. A motor 2 is disposed below the heating chamber 1. A rotary shaft 3 drivingly connected to the motor 2 is upwardly extended through the bottom surface of the heating chamber 1, and a rotatable table 4 is detachably inserted onto the upper end of the rotary shaft 3. A dish member 5 on which food to be cooked is placed is placed on the upper surface of the rotatable table 4.

In addition, an oscillation section 6 having various electric components therein is formed beside the heating chamber 1, and a magnetron 7 is disposed within the oscillation section 6.

A wave guide tube 8 is formed at one side wall of the heating chamber 1 where the magnetron 7 is installed for guiding the microwaves generated by the magnetron 7.

The operation of the conventional microwave oven will now be explained with reference to FIG. 1.

First, the dish member 5 on which food to be cooked is placed is placed on the rotatable table 4. Thereafter, electric power is supplied to the oscillation section 6. The magnetron 7 generates microwaves, while the rotatable table 4 is rotated.

The microwaves generated by the magnetron 7 are guided into the heating chamber 1 through the wave guide tube 8, for thus heating the food placed on the dish member 5.

However, since the conventional microwave oven is configured to generate microwaves by using the magnetron 7 and just supplying the microwaves into the entire space of the heating chamber 1, the density of the microwaves becomes lowered within the heating chamber 1, so that the resonant mode of the microwave oven is made simpler, whereby it is impossible to effectively heat the foods to be cooked.

SUMMARY OF THE INVENTION

Accordingly, it is an object of the present invention to provide a uniform heating apparatus for a microwave oven and a method thereof which overcome the aforementioned problem encountered in the conventional art.

It is another object of the present invention to provide an improved uniform heating apparatus for a microwave oven and a method thereof which are capable of more uniformly heating food by generating various resonant modes based on the kind of food.

To achieve the above objects, there is provided a uniform heating apparatus for a microwave oven which includes an oscillator unit having a wave guide tube for guiding microwaves generated by a magnetron to a lower portion of a heating chamber formed in a microwave oven main body, a resonant mode conversion unit for converting the microwaves guided to the lower portion of the heating chamber to have various resonant modes, a plurality of sensors for detecting the characteristics of a food when the microwaves, the resonant mode of which are converted by the resonant mode conversion unit, are supplied to the food in the heating chamber, and a controller for controlling the oscillator unit and the resonant mode conversion unit in accordance with the characteristics of the food detected by the sensors.

To achieve the above objects, there is also provided a uniform heating method for a microwave oven which includes the steps of guiding microwaves generated by a magnetron of an oscillator unit into a lower portion of a heating chamber, providing a resonant mode conversion unit for converting the microwaves guided to the lower portion of the heating chamber to have various resonant modes, and controlling the oscillator unit and the resonant mode conversion unit based on the characteristics of a food to be cooked by the microwaves.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
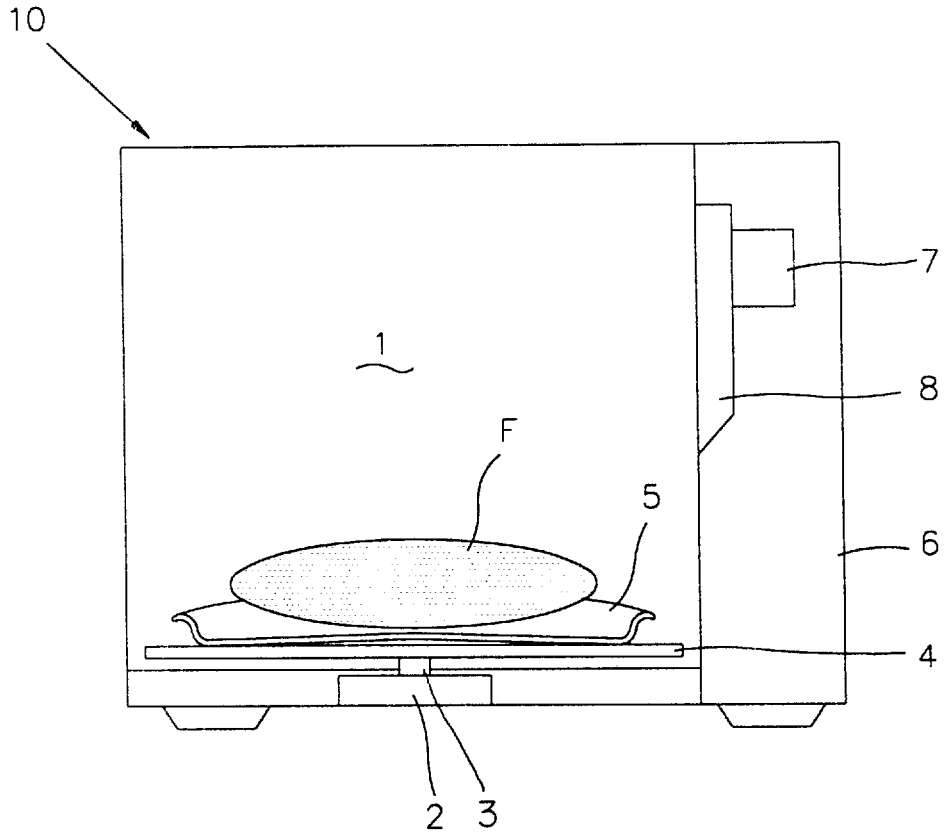
FIG. 1 CONVENTIONAL ART
FIG. 1 is a schematic cross-sectional view illustrating a conventional microwave oven.
Figure 2:
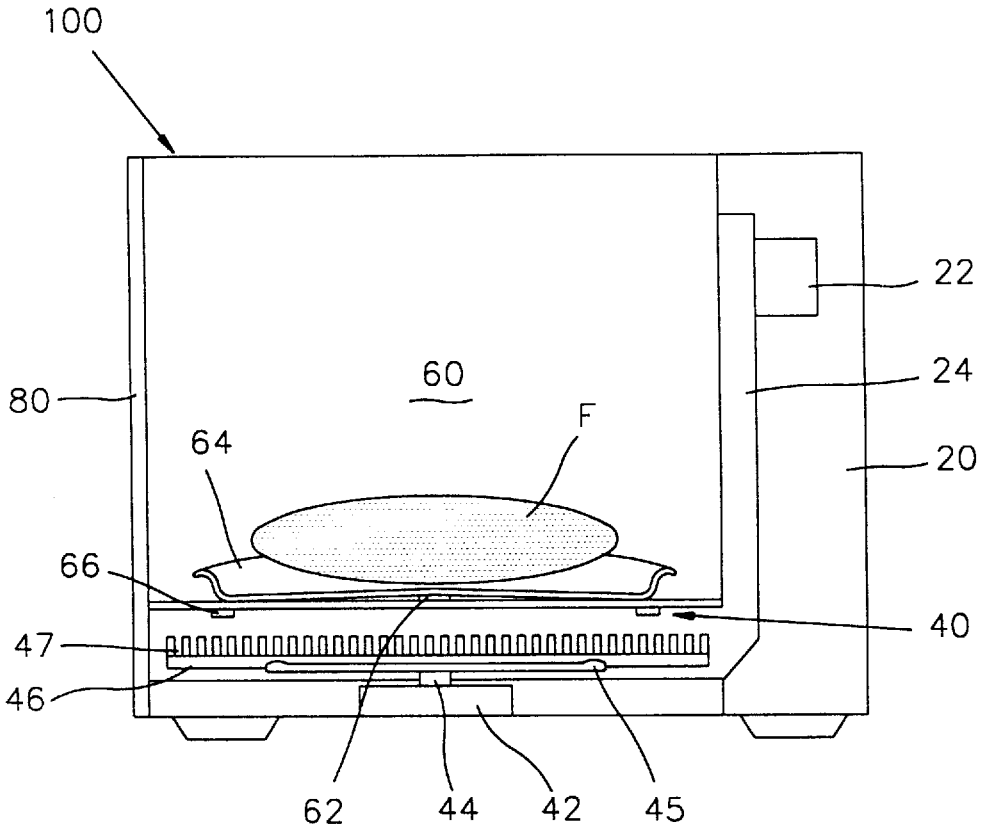
FIG. 2 is a schematic cross-sectional view illustrating a microwave oven incorporating a uniform heating apparatus according to the present invention.

FIG. 2 illustrates a microwave oven 100 incorporating a uniform heating apparatus according to the present invention.

A shown therein, a uniform heating apparatus for a microwave oven according to the present invention is adapted to a microwave oven which has an oscillator unit 20 for generating microwaves and guiding the same, and includes a resonant mode conversion unit 40 for converting a resonant mode of the microwaves into various resonant modes, and a controller 80 for controlling a heating chamber 60, the oscillator unit 20, and the resonant mode conversion unit 40, respectively.

The oscillator unit 20 includes a magnetron 22 disposed therein, and a wave guide tube 24 vertically formed on a lateral surface of the oscillator unit 20 for guiding the microwaves generated by the magnetron 22 into the resonant mode conversion unit 40.

The resonant mode conversion unit 40 disposed in the lower portion of the heating chamber 60 includes a motor 42, a rotary shaft 44 drivingly connected to the motor 42, a circular rotatable plate 45 detachably inserted onto the upper end of the rotary shaft 44, and a circular-shaped agitating plate 46 placed on the upper surface of the rotatable plate 45.

The heating chamber 60 includes a weight sensor 62 disposed in a lower surface of a dish member 64 placed on the upper portion of the weight sensor 62 (to be described later) for sensing the weight of food, and a microwave sensor 66 disposed below the dish member 64 for detecting the microwaves transmitted through food placed on the dish member 64 and reflected by the food thereto.

The controller 80 is disposed to one side of a door 90 of the heating chamber 60, for controlling the oscillator unit 20 and the resonant mode conversion unit 40 based on the data detected by the weight sensor 62 and the microwave sensor 66.

Figure 3:
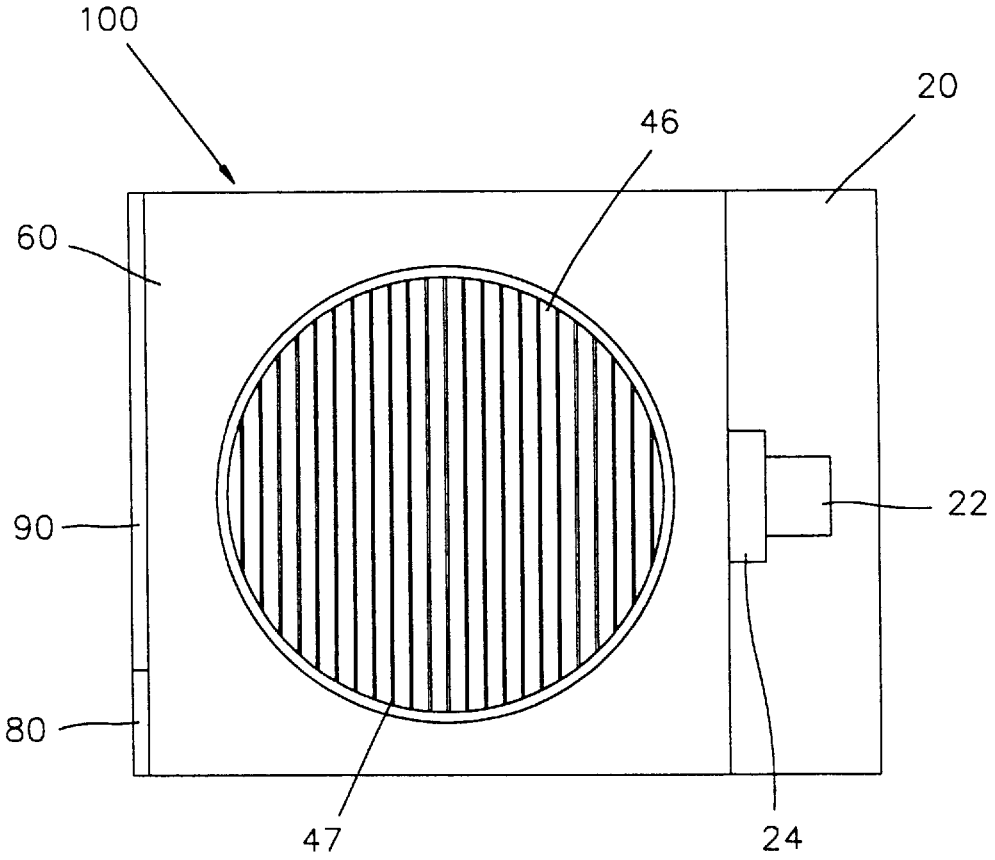
FIG. 3 is an inner plan view illustrating a uniform heating apparatus for a microwave oven according to the present invention.
Figure 4:
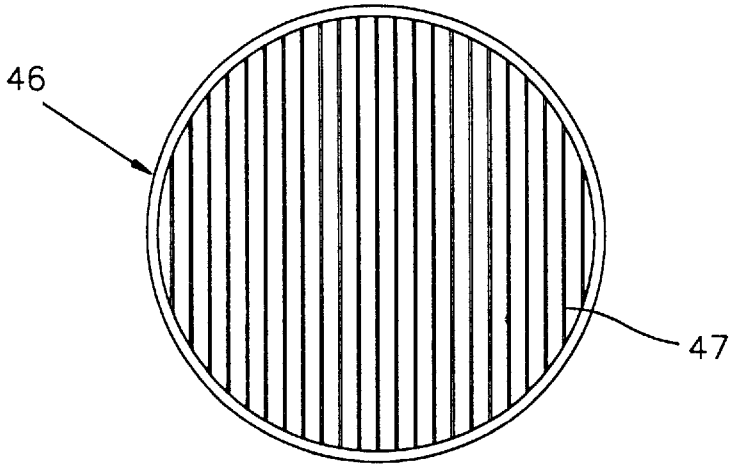
FIG. 4 is a plan view illustrating an agitating plate of a resonant mode conversion unit of the uniform heating apparatus for a microwave oven according to the present invention.
Figure 5:
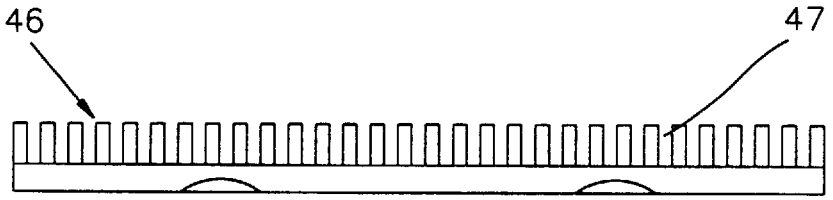
FIG. 5 is a lateral cross-sectional view of the agitating plate of FIG. 4.

In particular, as shown in FIGS. 3 and 4, a plurality of parallel slots 47 are formed at a regular interval in the upper surface of the agitating plate 46 of the resonant mode conversion unit 40 for converting the resonant mode of the microwaves guided by the wave guide tube 24 as the microwaves into various resonant modes are randomly reflected by the slots 47.

The operation and effects of the uniform heating apparatus for a microwave oven according to the present invention will now be explained with reference to FIGS. 2 through 5.

First, when electric power is supplied to the oscillator unit 20, the magnetron 22 of the oscillator unit 20 generates microwaves, and the agitating plate 46 of the resonant mode conversion unit 40 is rotated.

When the generated microwaves reach the agitating plate 46 of the resonant mode conversion unit 40, the rotating agitating plate 46 randomly reflects the microwaves incident thereto, for thus generating various resonant modes, and then the resonant mode-converted microwaves are provided into the heating chamber 60.

The weight sensor 62 of the heating chamber 60 weighs the food, and at the same time the microwave sensor 66 detects the microwaves which transmit through the food and are reflected by the same.

Thereafter, the controller 80 controls the oscillator unit 20 and the resonant mode conversion unit 40 based on the data detected by the weight sensor 62 and the microwave sensor 66. Namely, the controller 80 controls the oscillator unit 20 and the resonant mode conversion unit 40 so that microwaves having a proper intensity can be provided into the heating chamber 60 for uniformly heating the food.

The uniform heating method for a microwave oven according to the present invention comprises the steps of guiding microwaves generated by a magnetron of an oscillator unit into a lower portion of a heating chamber, using a resonant mode conversion unit provided in the lower portion of the heating chamber for converting the microwaves guided to the lower portion of the heating chamber to have various resonant modes, and controlling the oscillator unit and the resonant mode conversion unit based on the characteristics of a food to be cooked.

As described above, the uniform heating apparatus for a microwave oven and the method thereof according to the present invention are directed to providing various resonant modes by guiding microwaves to the lower portion of the heating chamber and generating microwaves proper to the kind of a food to be cooked, for thus uniformly cooking foods.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. A uniform apparatus for microwave oven, comprising:

an oscillator unit having a wave guide tube for guiding microwaves generated by a magnetron to a lower portion of a heating chamber formed in a microwave oven main body, the waveguide tube being vertically formed on a lateral surface of the oscillator unit and being extended to a lower portion of a heating chamber of the microwave oven;

a resonant mode conversion unit for converting the microwaves guided to the lower portion of the heating chamber to have various resonant modes, said resonant mode conversion unit including:

a circularly-shaped agitating plate having a predetermined thickness and diameter, the circularly-shaped agitating plate being positioned on an upper portion of another plate which is provided on a portion extending from the waveguide tube; and a motor for rotatable driving the agitating plate, and wherein in an upper surface of the agitating plate of the resonant mode conversion unit are formed a plurality of parallel slots formed therein at a regular interval whereby the microwaves guided by the wave guide tube are converted thereby to have various resonant modes, sensor means for detecting the characteristics of a food when the microwaves, the resonant mode of which are converted by the resonant mode conversion unit, are supplied to the food in the heating chamber, said sensor means comprising a weight sensor for weighing a food and a microwave sensor for detecting microwaves transmitted through a food to be cooked and reflected by the food; and a controller for controlling the oscillator and the resonant mode conversion unit in accordance with the characteristics of the food detected by the sensor means.

* * * * *